US008286304B2

(12) United States Patent
Valade

(10) Patent No.: US 8,286,304 B2
(45) Date of Patent: Oct. 16, 2012

(54) DEVICE TO FACILITATE MOVING A CURTAIN WITH LOOPS

(76) Inventor: Frederic Valade, Paris (FR)

( * ) Notice: Subject to any disclaimer, the term of this patent is extended or adjusted under 35 U.S.C. 154(b) by 331 days.

(21) Appl. No.: 12/439,963

(22) PCT Filed: Sep. 7, 2007

(86) PCT No.: PCT/FR2007/051892

§ 371 (c)(1),
(2), (4) Date: Apr. 13, 2009

(87) PCT Pub. No.: WO2008/029069

PCT Pub. Date: Mar. 13, 2008

(65) Prior Publication Data

US 2010/0024995 A1 Feb. 4, 2010

(30) Foreign Application Priority Data

Sep. 8, 2006 (FR) ..... 0607860

(51) Int. Cl.
*E05D 15/00* (2006.01)

(52) U.S. Cl. ..... 16/87.2

(58) Field of Classification Search ..... 16/93 R, 16/93 D, 87 R, 87.2, 87.4 R, 87.8, 87.6 R; 24/716; 4/558
See application file for complete search history.

(56) References Cited

U.S. PATENT DOCUMENTS

| | | | | |
|---|---|---|---|---|
| 2,320,003 | A * | 5/1943 | Madan | 16/87.8 |
| 3,384,244 | A * | 5/1968 | Falek | 211/123 |
| 6,223,389 | B1 * | 5/2001 | Walsh et al. | 16/87.4 R |

FOREIGN PATENT DOCUMENTS

| | | | |
|---|---|---|---|
| DE | 10052750 | A1 * | 10/2001 |
| EP | 1 153 560 | A2 | 11/2001 |
| EP | 1 535 548 | A1 | 6/2005 |
| FR | 2 819 389 | A1 | 7/2002 |
| FR | 2819389 | A1 * | 7/2002 |
| FR | 2 862 510 | A1 | 5/2005 |
| FR | 2862510 | A1 * | 5/2005 |
| FR | 2 868 931 | A1 | 10/2005 |
| JP | 11137416 | A * | 5/1999 |
| WO | WO 99/47031 | A1 | 9/1999 |
| WO | WO 9947031 | A1 * | 9/1999 |
| WO | WO 01/95774 | * | 12/2001 |
| WO | WO 01/95774 | A1 | 12/2001 |

* cited by examiner

*Primary Examiner* — Victor Batson
*Assistant Examiner* — Matthew Sullivan
(74) *Attorney, Agent, or Firm* — Oliff & Berridge, PLC

(57) ABSTRACT

A device to facilitate moving a curtain with loops along a pole includes at least two sliding elements to be fixed to at least one loop, each element having a face for fixing to the loop which is at least partly covered with an adhesive, the elements being kept a predefined distance apart by detachable and/or flexible holding means, at least before they are put on the loop.

17 Claims, 5 Drawing Sheets

Figure 1:
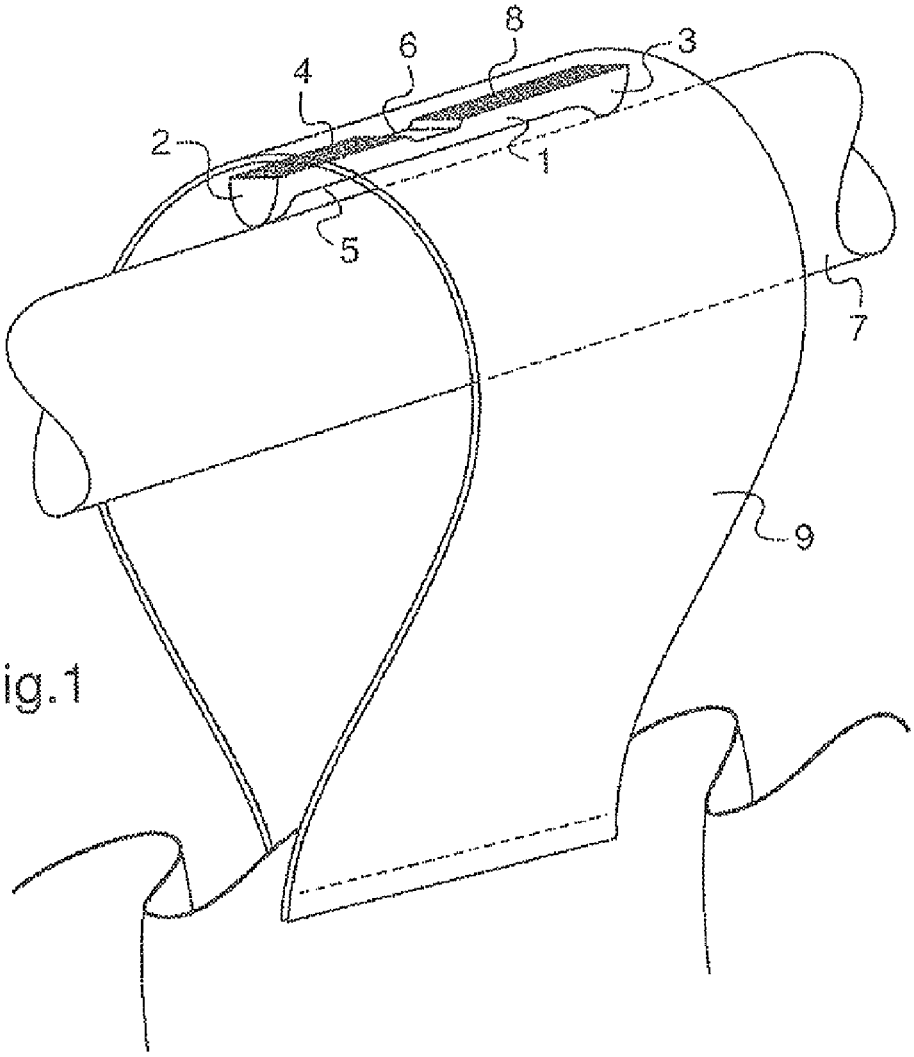

Fig.14
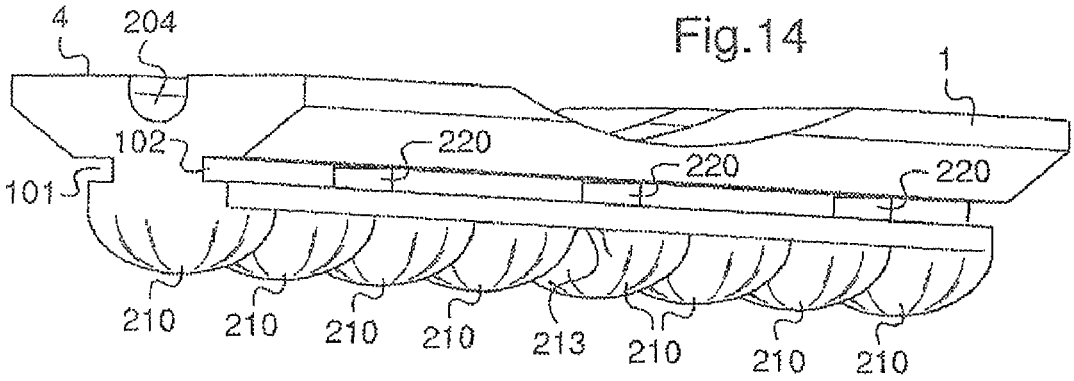
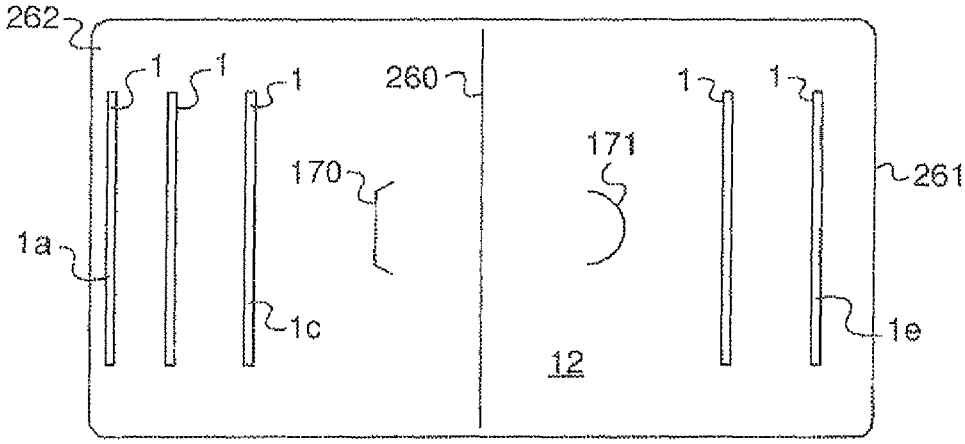
Fig.15
Fig.16
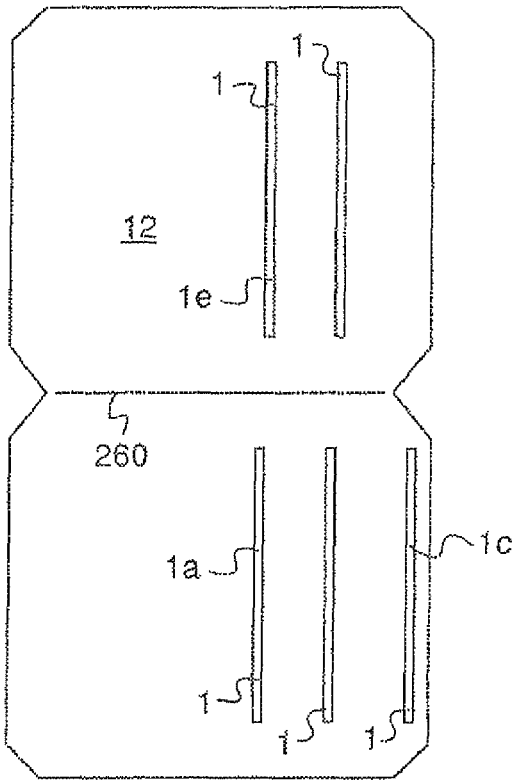
Fig.13
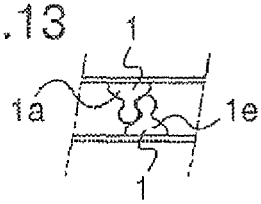

DEVICE TO FACILITATE MOVING A CURTAIN WITH LOOPS

The present invention relates to the field of curtains made of woven or non-woven material, with loops, and more precisely those arranged to slide on a pole.

The term "curtains" encompasses thick curtains and net curtains.

Certain curtains are made with loops most frequently of the same material, stitched or attached otherwise, for example by press studs or clips, in the form of a loop at regular distances over the top portion of the curtain, so that they can be hung from a supporting hole. With this method of coupling and in the absence of another system, the opening and closing of the curtain is made difficult because of the friction of the material of the loops on the pole, whether the latter be made of wood, metal or plastic. Opening or closing cannot be the result of a single movement and multiple attempts made with vigor may weaken or even cause the tearing of the curtain, the loops or the separation from the pole.

There are a few appropriate devices for solving this problem of the loops sliding on the poles.

Application EP 1153560 teaches of using a cylindrical part threaded around the pole, the loop being placed on the top portion of this part. The latter remains visible in its lower portion and must be calibrated to the diameter of each pole.

Application FR 281 9389 describes the use of an open ring threaded around the pole, being attached at the edge of the loop. This only partially reduces the friction, because the ring does not remove the contact of the pole with the portion of the loop that does not rest on this ring and therefore does not completely solve the problem.

Application WO 9947031 teaches of using a semi cylinder inserted between the pole and the loop, attached to the latter by a coupling strip of the Velcro® type. This method of attachment creates a bulge that is not very attractive. In addition, the disadvantage remains that, to operate, the device must match the diameter of the pole.

In the same vane, application FR 2 862 510 discloses a semi cylinder having on its inner face many superposed protuberances to reduce the friction on the pole and on the outer face excresancies? or spurs intended to allow attachment to the loop. It depends on the diameter of the pole and the spurs passing through the material of the loop may be visible and damage it. Publication WO 01/95774 teaches of using a rectangular strip made of semi rigid material flexible enough to be adapted to the arc of the pole, which passes through three sliding pads and keeps them parallel between the pole and the inner face of the loop. Spurs on the outer face of this strip and an attachment of the Velcro® type make it possible to attach the assembly to the loop. Depending on the diameter of the pole, the positioning of the sliding pads does not make it possible to prevent any contact of the loop with the pole. The attachment spurs may be visible through the material of the loop and damage it. The installation of this device is relatively lengthy and requires dexterity.

Publication WO 99/47031 teaches of using a single flexible strip the adhesive outer face of which is bonded to the inside of the loop and the more slippery inner face ensures contact with the pole. This solution does not reduce the friction area but only its coefficient and has difficulty withstanding washing or cleaning.

Application FR 2868 931 discloses another device designed to make the sliding of the loops easier.

Application EP 1535 548 describes an element designed to be interposed between the pole and the loops, comprising on one side a plurality of protuberances making it possible to reduce the friction coefficient with the pole and on the other side excrescencies designed for coupling the element with the loop.

It appears that all these devices provide only partial and not completely satisfactory responses to the problem of the sliding of the loops on the pole, and have one or more of the following disadvantages:

- these devices have to be added after manufacture of the curtain loops,
- they may be awkward to install because installation requires the curtains to be taken down and several elements to be assembled,
- the area of contact or of friction with the pole remains considerable,
- the devices must be adapted to the diameter of the pole,
- the attachment is reversible and likely to weaken the loops when the latter are made in a thin or fragile material.

Consequently there remains a need to remedy at least one of these disadvantages, thanks to a device that is designed to make the loops easier to slide, that is relatively attractive, not very costly, reliable, easy to install and presenting a reduced risk of damaging the loops.

According to one of its aspects, the subject of the invention is a device designed to make it easier to move a curtain with loops on a pole, comprising at least two sliding elements to be attached to at least one loop, each element having a face used for attachment to the loop which is coated with an adhesive, the sliding elements being held a predefined distance apart by detachable and/or of flexible retention means, at least before they are placed on the loop.

In one embodiment of the invention, the retention means are detachable so as to be separated from the sliding elements once the latter have been attached to the loop.

In another exemplary embodiment of the invention, the retention means are flexible and are not separated from the sliding elements once the latter have been attached to the loop.

The invention has numerous advantages.

First of all, the device can be relatively simple to manufacture and install, whether it be during the making of the curtains or afterwards.

The invention makes it possible to produce sliding elements that do not harm the appearance of the curtain, the sliding elements being able to be substantially invisible because they are attached only to the inner face of the loop.

The smooth operation of the device is relatively independent of the diameter of the pole, the sliding elements being adaptable to the diameter of the pole and to the curve of the loop.

Therefore, a curtain equipped with sliding elements may easily be installed on a pole with a different diameter during a new installation.

The device can be easily adapted to several pole diameters, notably when it comprises at least five sliding elements.

The length of the sliding elements can be easily adapted to the width of the loop if necessary.

The device may suit all types of loops, even those with a knot.

The sliding elements may be made so as to hold the loop rigid and without folds in its width. This allows an ordered alignment between loops, whether the curtain is in the open or closed position.

The sliding elements make it possible to prevent wear of the loops and prevent them turning black through their contact with the pole. The sliding elements may, in certain embodiments where they extend over substantially the whole width of the loop, reduce the risk of crumpling or creasing the loop.

The sliding elements may provide great flexibility of movement, by allowing the loop to lift slightly when the latter is pulled sideways, which a ring or a cylindrical part surrounding the pole cannot do.

The sliding elements, once installed, make it possible to iron the loop flat. Their presence does not hamper placing the curtain in a blister pack, and does not change the commercial presentation.

The attachment of the sliding elements is final because it can withstand washing of the curtains.

The device is suitable for all types of curtain: from the very light to the very heavy, transparent or opaque.

The manufacture of the device may use relatively little material and its production cost can remain relatively small.

The device may easily be produced in various lengths, depending on the width of the loops to be fitted, often having standard dimensions.

The device provides ease of use by the operators, the sliding elements being easy to manipulate before their installation, thanks to the retention means.

The sliding elements may be installed by bonding by applying contact pressure and/or by using, if necessary, a heat press and/or activation by ultraviolet or ultrasound.

The device may comprise at least three, better four, still better five sliding elements, or even more.

The retention means may comprise a sheet or card provided with slots into which the sliding elements are snapped. Each sliding element may have in cross section an Ω shape, so as to be easily snapped into the corresponding slot. The sheet or card may be a sheet of paper, cardboard or one or more plastic materials, for example.

The sliding elements may also be prepositioned in a manner other than by snap fitting, for example by means of a low-strength adhesive between the sliding elements and a base such as a sheet or a card.

The sliding elements may also be attached to a base such as for example a sheet, a film or a card by local melting of material, thanks to tack welds between the sliding elements and the base.

Again in a variant, the sliding elements are connected together by bridges of material which hold them a predefined distance apart. These material bridges can be cut so as to be removed once the sliding elements have been attached to the loop. As a variant, the material bridges are sufficiently flexible to be left in place on the loop once the sliding elements have been attached.

The retention means may comprise a mark making it possible to position the top fold of the loop relative to the sliding elements, before they are attached to the loop.

The mark may be produced for example by a printed or preformed mark or by a cutout of a base, for example in the form of at least one V-shaped notch, for example two V-shaped notches that face one another on the lateral edges of the base, the latter being positioned parallel to the edges of the loop when the sliding elements are installed on a loop.

The retention means may be arranged so as to be folded in two for the purpose of installing the sliding elements on the loop when the latter already forms a ring.

The retention means may comprise a preformed fold line, for example a lesser thickness of material, or a line of weakness, for example a groove or a cutout designed to make it easier to fold along a predefined line.

In one exemplary embodiment of the invention, the retention means comprise a base such as a sheet or a card that is folded in a central region that has no sliding elements. The fold line of the base may be parallel to the sliding elements or, as a variant, perpendicular to the latter.

The sliding elements are for example closer to a free edge of the base than the fold line. This may reduce the risk of the sliding elements becoming detached when the base is folded and make the latter easier to handle.

A perpendicular orientation of the sliding elements to the base may make them easier to handle.

The distance between the sliding elements is advantageously greater than the width of a sliding element, which may allow sliding elements supported by both opposite uprights of a loop to fit between one another.

The spacing between the sliding elements may therefore be chosen so that the sliding elements supported by one of the uprights of the loop fits between the sliding elements supported by the other upright of the loop, when both uprights of the loop are pressed against one another, for example because the curtain is packaged flat or ironed.

In one exemplary embodiment of the invention, the sliding elements are placed on the base so that, when the loop is folded, the sliding elements furthest from the fold line of the loop press laterally against one another. This may ensure an equal lengthwise positioning of the two halves of the loop relative to one another, which is advantageous when the loop is attached to the curtain after the sliding elements are installed.

The sliding elements are advantageously identical, at least one portion of the sliding elements being for example made by injection or by extrusion, for example in a laden or unladen thermoplastic, such as PVC, polyester, polyacrylate, PP or PE, PBT, polyamide, polyacetal, or a mixture of the latter, this list not being limiting.

The sliding elements are preferably made with a transparent thermoplastic, which reduces their visibility. When the retention means are not separated from the sliding elements once the latter have been installed on the loop, the retention means are equally advantageously produced with a transparent thermoplastic.

The sliding elements advantageously extend over at least half of the width of the loop, preferably over practically all of its width, continuously or non continuously.

The sliding elements may comprise bars or have other shapes and preferably all being bar-shaped.

A further subject of the invention is a loop comprising at least two independent sliding elements bonded on their inner face, the loop already being attached to the curtain or needing to be attached to a curtain.

A further subject of the invention is a loop comprising at least two sliding elements bonded thereon and linked by means for holding these sliding elements before they are installed on the loop, these retention means being flexible and preferably transparent. The loop may be attached to a curtain or need to be attached to a curtain.

A further subject of the invention is a method for manufacturing a curtain comprising loops, wherein at least two sliding elements are bonded to at least one loop, preferably sliding elements prepositioned thanks to the detachable retention means. In exemplary embodiments of the invention, the device making it easier to move a curtain with loops on a pole by removing the friction of the loops is of the type comprising bar-shaped sliding elements, interposed between the loop and the pole, comprising at least five elements that are identical and independent of one another, forming a set of parallel elements attached to each loop before it is stitched to the curtain.

Each bar-shaped element may have a flat top portion onto which is deposited an adhesive attachment means designed to be activated by thermal press, ultrasound or ultraviolet, so as to be bonded individually and definitively in the width of the loop on to its inner face when the device is installed.

The elements may be prepositioned in sets of at least five, during their manufacture, on a removable and discardable handling base strip which temporarily holds until installation each of the independent elements comprising the device, by their portion opposite to their adhesive flat surface, in a position in which, once the elements have been bonded to the loop, creates a gap between each of them that is at least equal to the width of an element, so that they can fit between one another when the loop thus equipped is folded in two in order to be stitched to the curtain, ironed or packed flat, and with a greater value calculated so as to remove any contact of the loop with the pole irrespective of its diameter.

In non limiting exemplary embodiments of the invention:

each elongated sliding element may have, in addition to its surface designed to receive the adhesive material used to attach it to the inner face of the loop, a shape having a cross section chosen from a polygonal, notably rectangular, square, triangular, semi-cylindrical cross section or cross-section or in the shape of an Ω.

each sliding element may come into contact with the pole over a more or less extensive surface, depending on its shaper for example a surface that is not completely cylindrical in order to reduce the friction, each sliding element may for example have its ends as the only points of contact with the pole, each sliding element may have, notably at its ends, a compressible protuberance, for example in the shape of an arc of a circle or a rib that is outwardly convex, whose shape associated with the flexibility of the material allows the press to apply an equal pressure to the whole of the element in order to ensure optimum bonding of all its surface, each sliding element may comprise, on the side intended to come into contact with the pole, a succession of bosses, for example each with a substantially spherical shape, coming into contact with the pole at their top, these bosses may be distributed over the sliding element at a larger distance apart in the middle region of the sliding element, in order to maintain a certain flexibility of the sliding element, the sliding elements may be positioned, for example at regular intervals, in rows on the base, the sliding elements each having for example a substantially hemispherical surface designed to contact the pole, a protective, non-adhesive film may be in contact with the adhesive material deposited on each sliding element and may cover all of the elements, each sliding element may have a crank or a lesser thickness at the center or one or other end or at both ends, in order to compensate for the extra thicknesses that are caused by any manufacturing stitching of the loop depending on whether it is made in the central portion or at the side, each sliding element may, for example, comprise on its surface facing the loop a recess, for example of cylindrical shape with its axis perpendicular to the longitudinal axis of the sliding element, obtained for example by milling the element, the recess also being able to have another shape, notably when the sliding element is made by injection, the sliding element may comprise, on their face intended to adhere to the loop, a surface state designed to make the adhesive easier to bind, the sliding elements may have, on the face assembled to the loop, a central longitudinal groove, for example with a rounded bottom in cross section, such a groove reducing the quantity of material of the sliding element and being able to facilitate the mechanized handling of the sliding elements during manufacture, the sliding elements may comprise one or more lateral cut-outs, notably if produced by injection, in order to reduce the quantity of material used to produce them.

A further subject of the invention, according to one of its aspects, is a method for manufacturing a device as fined above, wherein each sliding element is manufactured by injection or extrusion of a semi rigid material followed by the application of adhesive material of the type designed to be activated by hot pressure, ultra violet or ultrasound during installation on the loop, and then positioned on a handling base and if necessary covered by a protective film.

The invention also extends to a curtain, characterized in that it comprises loops on each of which the sliding elements of a device according to the invention are bonded, these sliding elements being positioned relative to the loop prior to being attached to the loop so that one side of the central element is adjacent to the fold line of the loop, this offset relative to this top middle fold and the gaps between the sliding elements allowing all of said elements to fit between one another when the loop, once equipped, is folded in two in order to be stitched to the curtain, be ironed or packed flat.

Figure 2:
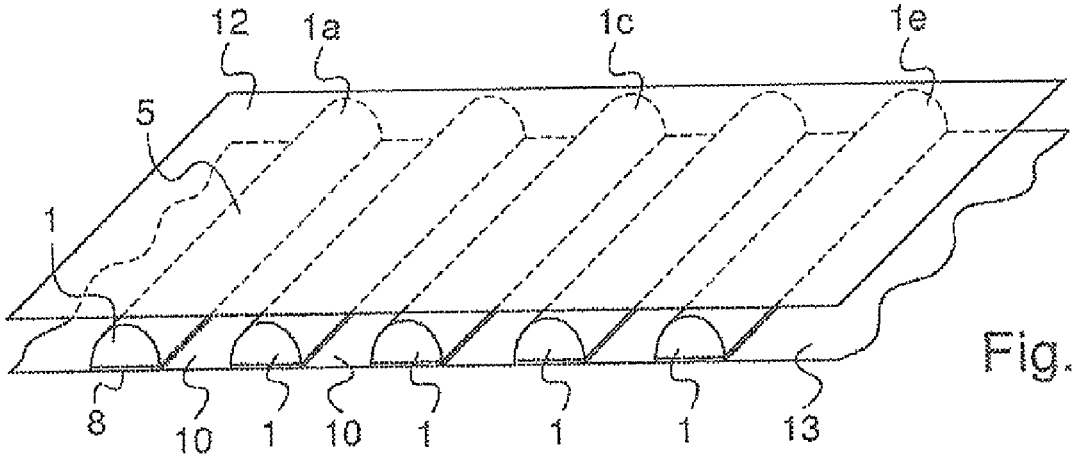
Figure 4:
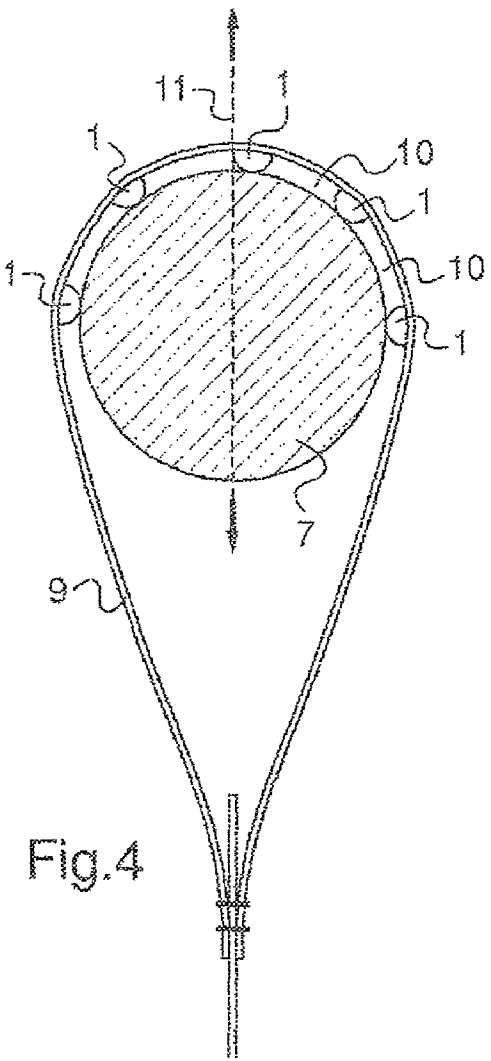
Figure 3:
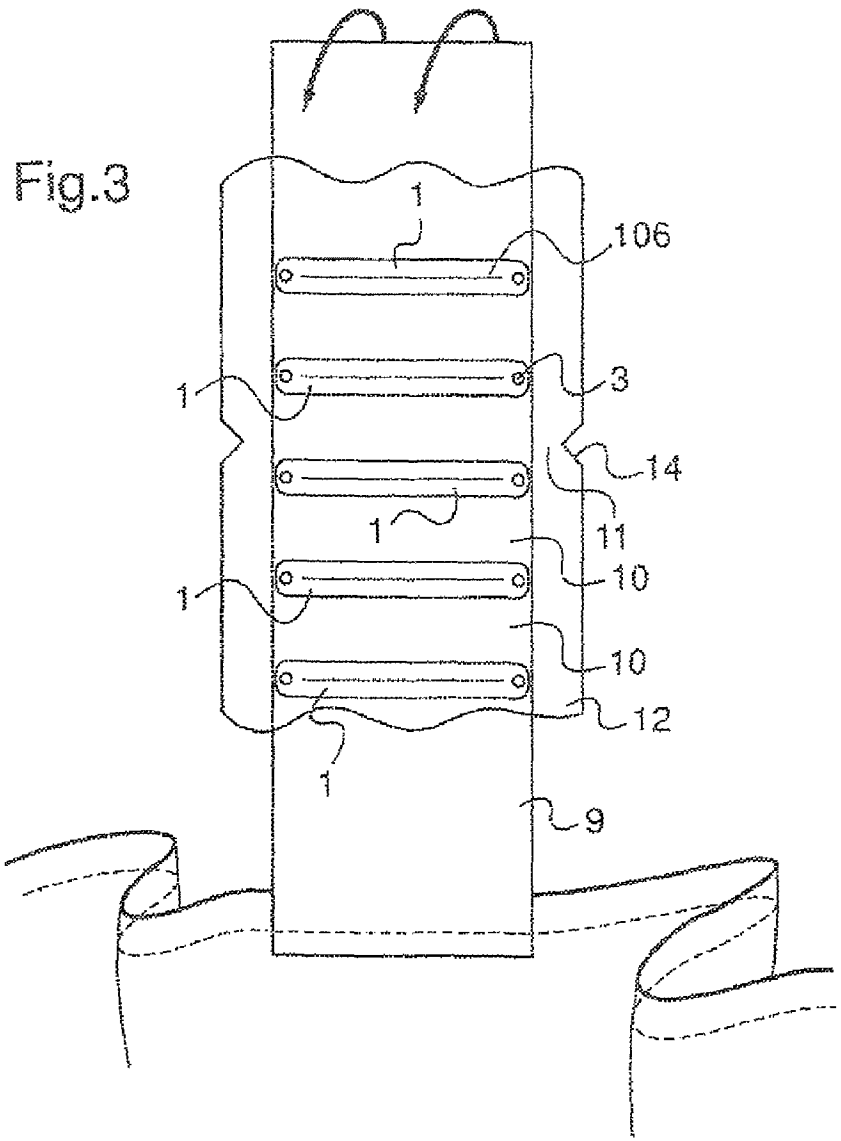
Figure 5:
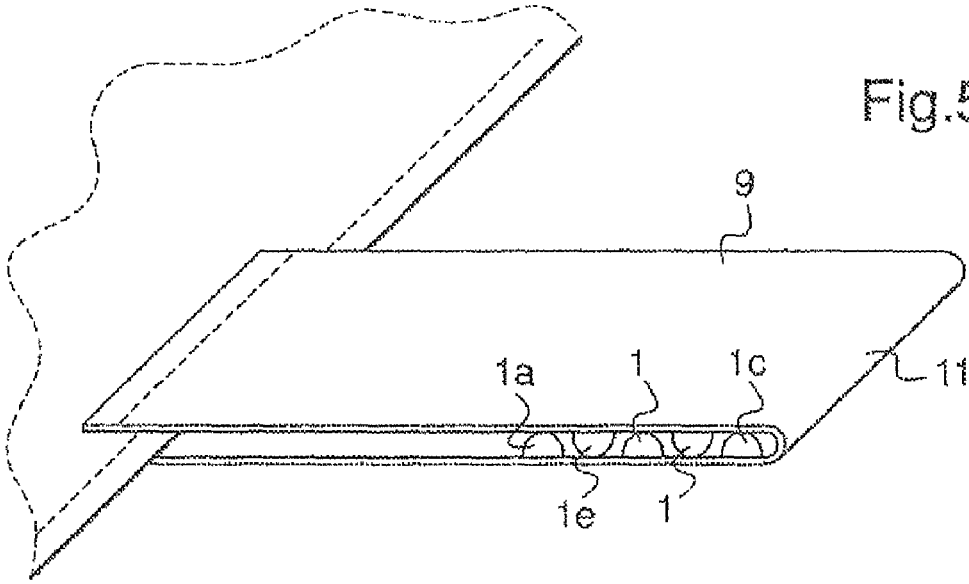
Figure 6:
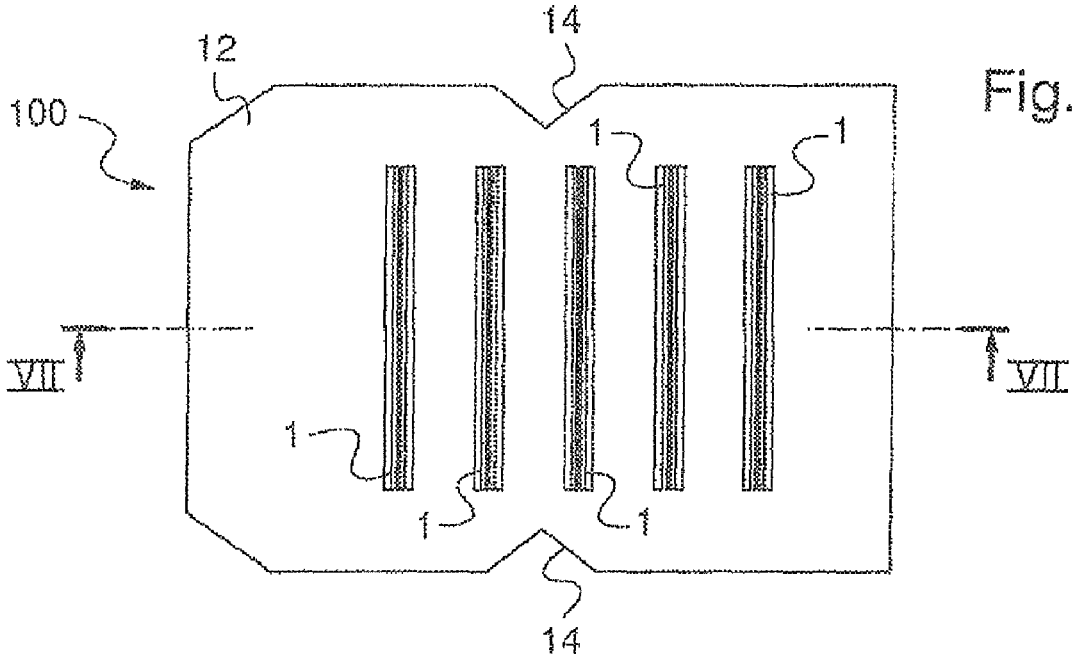
Figure 7:
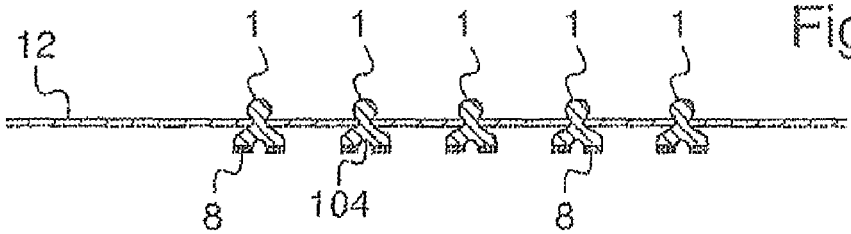
Figure 8:
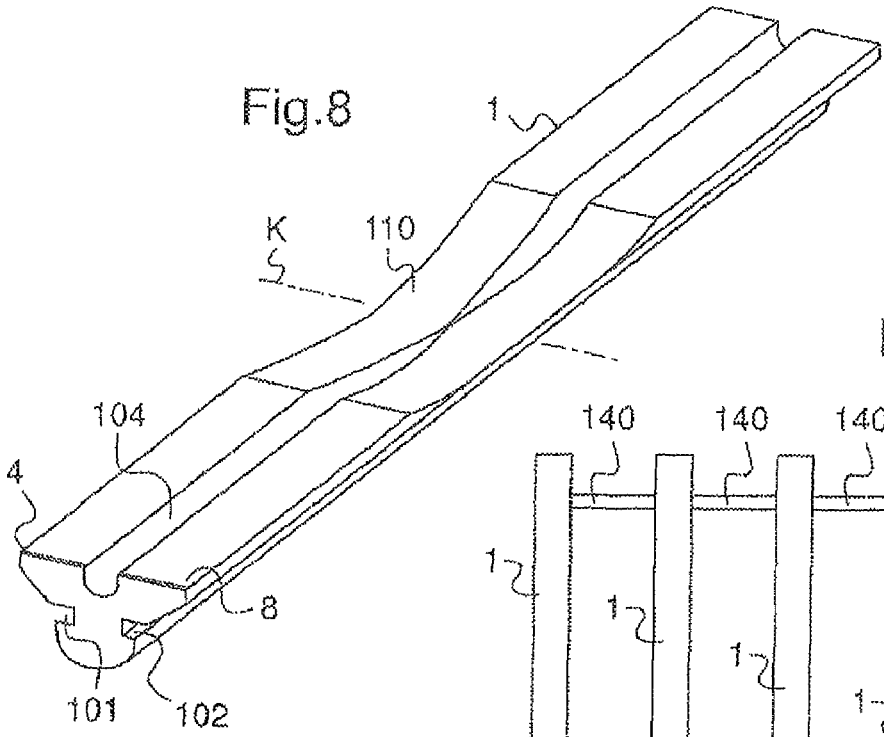
Figure 9:
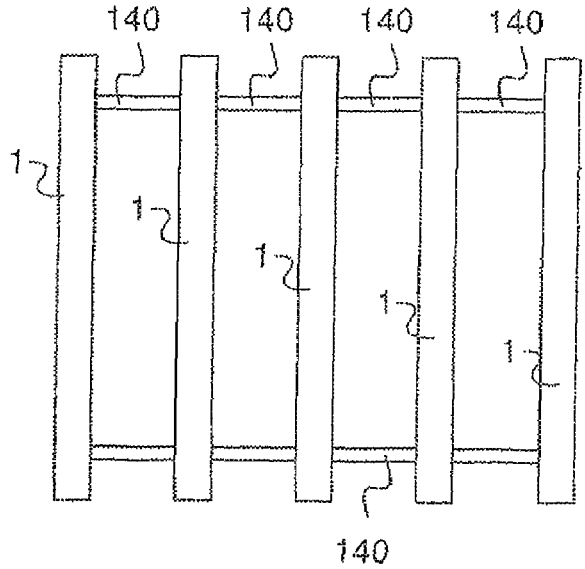
Figure 10:
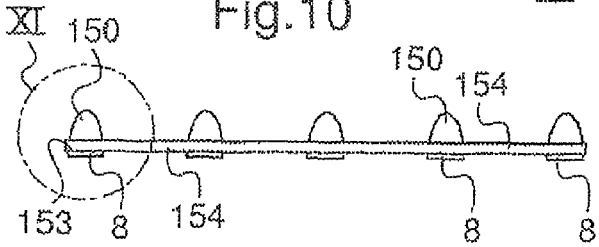
Figure 11:
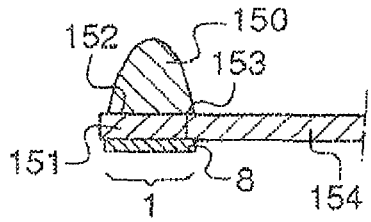
Figure 12:
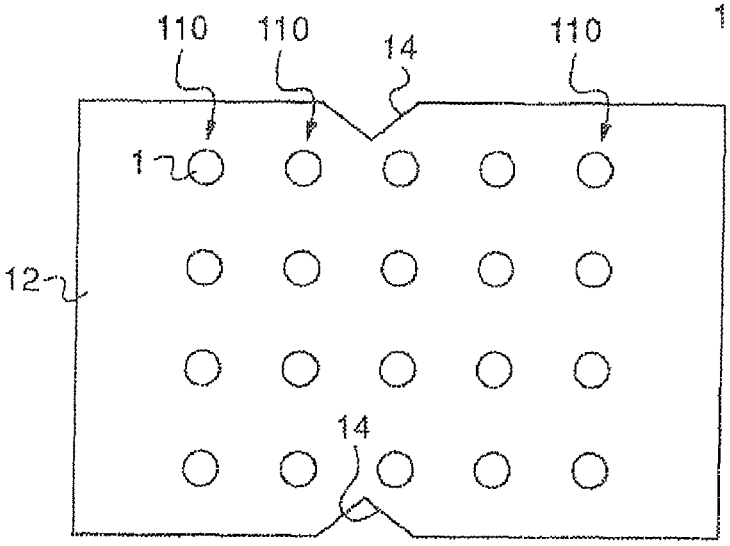

The invention may be better understood on reading the following detailed description of a non-limiting exemplary embodiments of the invention, and on examining the appended drawing in which:

FIG. 1 is a view in perspective of an exemplary sliding element placed on a loop, FIG. 2 represents an exemplary device produced according to the invention before installation of the sliding elements, FIG. 3 represents the elements of the device attached to a flat loop, FIG. 4 is a schematic section of the sliding elements attached to the loop resting on the pole, FIG. 5 is a view of a loop folded on itself, equipped with the sliding elements, FIG. 6 represents a top view of another example of the device, FIG. 7 is a section on VII-VII of FIG. 6, FIG. 8 represents separately, in perspective, an exemplary sliding element, FIG. 9 is a view similar to FIG. 6 of a variant embodiment of the device, FIG. 10 is a view in section similar to FIG. 7 of a variant embodiment of the device, FIG. 11 shows the detail XI of FIG. 10, FIG. 12 is a view similar to FIG. 6 of a variant embodiment, FIG. 13 illustrates the positioning of the two sliding elements furthest from the fold of the loop, in a variant embodiment of the invention, FIG. 14 represents a variant sliding element, FIGS. 15 and 16 represent in a top view variants of devices according to the invention In the figures, certain details have been intentionally represented without observing the true proportions, for the purposes of clarity of the drawing.

FIGS. 6 to 8 show a device 100 designed to make it easier to slide a loop of a curtain. This device comprises a base 12 serving as a retention means, on which the sliding elements 1 are prepositioned before they are attached to the loop.

The base 12 is shown for example in the form of a strip of paper, cardboard, metal, or plastic film.

In the example illustrated, the device comprises five identical sliding elements 1, each shown in bar form, as for example that shown separately in FIG. 8.

Each bar-form element 1 has a face 4 on which is deposited an adhesive 8 for example of the type designed to be activated by thermal press, ultra violet or ultrasound, so as to be bonded individually and definitively in the width of the loop 9 on its inner face. The adhesive is for example that marketed by BOSTIK, polyamide-based, under the name THERMELT, the sliding element being for example made of copolyamide-based cristamid or polyester-based PBT. There is no spur or clip or a fastener of the Velcro® type as another fastening system in the illustrated example.

Each element 1 may have, in cross section, a general Ω-shape as illustrated in FIG. 8.

Such a section makes it possible to define two opposite longitudinal grooves 101 and 102 which are used to snap fit the sliding element into a through-slot of the base 12 as illustrated in FIG. 7.

The cross section of each sliding element 1 may or may not be constant.

In the example illustrated in FIG. 8, the sliding element has a central recess 118 half way along, for example of cylindrical shape about an axis K perpendicular to the longitudinal axis of the sliding element. Such a recess 118 is for example obtained by milling the sliding element when the latter is manufactured by extrusion but may also be produced by molding.

The face 4 may comprise a groove 104 half way along. Such a groove 104 makes it possible to reduce the quantity of material used to produce the sliding element and facilitate its mechanized conveyance after manufacture.

The sliding elements 1 are designed in the example of FIGS. 6 to 8 to be bonded to the loop when held by the base 12, then the latter is removed.

In the example illustrated, each sliding element is designed to come into contact with the pole over the whole length of the generatrix of the top 106.

As a variant, each sliding element 1 may have contact with the pole over only a portion of its length, for example have as the only points of contact with the pole 7 regions close to its axial ends 3 in order to reduce the friction coefficient as much as possible. The contact zone of the element 1 with the pole 7 is materialized for example as illustrated in FIG. 1 by a compressible protuberance 3, for example in the shape of an arc of a circle, or of a convex rib the shape of which, associated with the flexibility of the material, allows the press to apply equal pressure over the whole length of the element 1 in order to ensure an optimum bonding of its whole surface during the operation of attaching the loop 9.

In the example of FIGS. 1 and 2, the elements 1 are prepositioned during their manufacture in sets of five at lest on a handling base strip 12, that can be removed and discarded, which holds, temporarily until they are installed, each element 1 by its portion 5 opposite to its adhesive surface 4, the latter being flat in the example illustrated.

The adhesive material deposited on the surface 4 is protected by a non adhesive protective film 13 that can cover all of the elements is necessary.

The sliding elements may therefore be presented sandwiched between a handling base strip 12 and the non adhesive protective film 13 as shown in FIG. 2.

By their positioning on the handling base strip 12, the elements 1 leave a gap 10 between each of them. These gaps between the elements 1 are calculated so as to eliminate any contact of the loop 9 with the pole 7 irrespective of its diameter. A gap 10 is at least equal to the width of an element 1 and the gap has a greater value for the one concerning the lateral elements 1*a* and 1*e* of the device.

The central element 1*c* of the set of five elements is placed adjacent to the middle fold line 11 of the inner face of the loop 9.

This arrangement of the elements with respect to one another and relative to the middle fold of the loop 11 allows them to fit between one another when the loop 9, once equipped, is folded in two in order to be stitched to the curtain, be ironed or packed flat.

The protective film 13, having already been removed from the handling base strip 12, makes it possible to adjust the positioning of the set of elements on the inner face of each loop 9 in order to comply with the placement of the central element 1*c* adjacent to the middle fold line, an operation that is made easier by the presence of a mark 14 on the handling base strip 12, as illustrated in FIG. 3.

This handling base strip 12 may comprise, as a temporary retention means, repositionable adhesive elements.

After the attachment by bonding of the sliding elements on the inner face of the loop, the strip 12 may be detached from the elements 1, which are separated from one another. The loop 9 thus equipped with the device is then ready to be stitched to the curtain, if necessary.

Each element 1 may have, on the flat surface 4, as illustrated, a lesser thickness in at least one defined chosen zone, either at the center 6 or at one or other end or at both ends 2 in order to compensate for the bulges caused by any manufacturing stitching of the loop 9, depending on whether this stitching is carried out in the central portion or at the side.

Each element 1 may have a bonding zone substantially equivalent to the width of the loop securing it to the loop 9 over virtually the whole of its width by the bonding action, so as to keep the loop 9 with no fold or pleat despite the repeated lateral pulls when the curtain is open or closed.

Naturally, the length of the elements is suited to the width of the loop, being adjustable if necessary by cutting the ends.

In the variant illustrated in FIG. 9, the sliding elements 1 are linked together by bridges of material 140 which hold them at a predefined distance apart.

The bridges of material 140 may be cut and removed after the sliding elements have been bonded to the loop. As a variant, the bridges of material are left in place after the sliding elements are installed. In this case, the bridges of material 140 are sufficiently flexible not to hamper the operation of the loop or compromise its appearance.

The bridges of material 140 and the sliding elements are for example made by injection of a transparent thermoplastic.

In the variant of FIGS. 10 and 11, each sliding element 1 is formed by a body 150 and a base portion 151 of a film 152, attached via a face to the body 150 and supporting the adhesive 8 on the other face 153. The film 152 is for example a thin film of a transparent thermoplastic common to all the sliding elements.

The connecting portions 154 linking the base portions 151 attached to the body 150 are means for holding the sliding elements a predefined distance apart. The connecting portions 154 are flexible and remain in place after bonding to the loop.

In the variant illustrated in FIG. 12, pluralities of sliding elements are placed in parallel rows 110.

Each plurality may replace a bar-shaped sliding element from the examples described above.

Each sliding element 1 has the shape for example of a hemisphere or a pin, being attached removable to the base 12.

In a row 110, the sliding elements may be identical or different. The distance between them may or may not be constant.

Each sliding element may, if necessary, receive a surface processing designed to reduce the friction, for example a deposit of a low friction coefficient material. As a variant, each sliding element is made by bi-injection of material, with, for example a flexible material to produce the base of the sliding element attached to the loop and a material with a lesser friction coefficient in order to come into contact with the pole.

FIG. 13 illustrates the possibility for the sliding elements, for example those in the shape of a bar as described above, to be positioned on the base 12 so that the sliding elements furthest from the top of the loop come into contact laterally when the loop is folded.

This makes it possible to precisely position the two halves of the loop before it is installed on the curtain when the sliding elements are bonded to a loop prior to being attached to the curtain.

The sliding element 1 shown in FIG. 14 comprises, on the side opposite to the face 4, a plurality of bosses 210, for example each of substantially spherical shape, which are designed to come into contact with the pole at their top. These bosses 210 are for example made by injection with the sliding element.

For example they are between six and twenty in number. The bosses 210 may be placed so as to arrange between them a gap 213 that is larger in the middle region of the sliding element so as to maintain its flexibility. One or more cutouts 220 may be made through the sliding element between the grooves 101 and 102 in order to lighten the sliding element, as illustrated in this figure.

In the variant illustrated in FIG. 15, the base 12 comprises, in a middle region, a fold line 260 comprising for example a groove and the sliding elements 1 are closer to the opposite free edges 261 and 262 of the base 12. The latter may be offered to the user already folded, with the faces 4 showing. The base 12 may be kept folded by interaction of cutouts 170 and 171 made in the latter.

In the variant illustrated in FIG. 16, the sliding elements are made in the shape of bars oriented perpendicularly to the fold line. Sliding elements 1 are present on each flap of the base 12 and may fit between one another when the base 12 is folded on itself, for the purpose of installing the sliding elements on the loop.

The width of the base 12, measured perpendicularly to the fold line, is more than double the width of the loop, so that once the base is folded, a portion of the base adjacent to the fold line overlaps the loop laterally, this portion having no sliding elements and being easy to handle for a precise positioning of the sliding elements on the loop.

Naturally, the invention is not limited to the illustrated examples. Particular features of producing these examples may be combined together within variants that are not illustrated.

"Removable" and "detachable" should be understood as being synonymous.

"Comprising a" should be understood as being synonymous with "comprising at least one".

The invention claimed is:

1. A loop comprising at least five independent sliding elements comprising bars, the at least five sliding elements extending longitudinally and being oriented in parallel rows, each having a cross-section in a general shape of Ω, each of the sliding elements comprising a plurality of bosses as the only points of contact of each of the sliding elements with a pole on which the loop is placed, and each of the sliding elements being definitely and individually bonded via an adhesive to an inner face of the loop, the elements being positioned on the loop so as to fit one between another when the loop is folded in two.

2. A curtain comprising a loop as defined in claim 1.

3. The loop of claim 1, wherein at least two of the five sliding elements are positioned so that the sliding elements furthest from the top of the loop come into contact laterally with a pole on which the loop is placed.

4. The loop of claim 1, wherein the loop is made of a woven material.

5. A method for manufacturing a loop as defined in claim 1 comprising:

positioning at least two sliding elements on the loop, while the sliding elements are associated with removable retainers; and bonding the at least two sliding elements to the loop.

6. An apparatus to carry out the method as defined in claim 5, comprising: at least two sliding elements configured for attachment to at least one loop, each sliding element having a face used for attachment to the loop, the face being at least partially coated with an adhesive, the at least two sliding elements being held at a predefined distance apart by detachable and/or flexible retainers, at least before they are placed on the loop.

7. The apparatus of claim 6, the retainers comprising a sheet or card provided with slots into which the sliding elements are fitted.

8. The apparatus of claim 7, each of the at least two sliding elements having a cross-section in a general shape of an Ω, so as to snap into a corresponding slot.

9. The apparatus of claim 6, the retainers comprising a mark making it possible to position a fold of a top of the at least one loop relative to a support and to the at least two sliding elements, before the at least two sliding elements are attached to the loop.

10. The apparatus of claim 9, wherein the mark is a cut out of the support or a marking.

11. The apparatus of claim 10, the retainer comprising a folded card or a sheet, the fold of the retainers allowing folding of one or more flaps, one over the other.

12. The apparatus of claim 10, the retainer comprising a folded card or a sheet, the fold of the retainers being oriented perpendicularly or parallel to the at least two sliding elements.

13. The apparatus of claim 6, wherein the predefined distance between the at least two sliding elements is chosen so that the at least two sliding elements are supported by a first upright of the loop fit between the sliding elements and supported by a second upright of the loop, when the first and second uprights of the loop are pressed against one another.

14. The apparatus as claimed in claim 6, comprising at least five identical and independent bar-shaped sliding elements configured to be placed between the loop and the pole, the at least five identical and independent bar-shaped sliding elements form a set of parallel elements attached to each loop before each loop is stitched to the curtain; wherein each bar-shaped sliding element includes a flat top portion onto which is deposited an adhesive material designed to be activated by heat press or ultrasound, so as to be bonded individually in the width of the loop and onto its inner face when the apparatus is installed; wherein during their manufacture, the sliding elements are prepositioned in sets of at least five on a removable and discardable handling base strip which holds each of the independent bar-shaped sliding elements temporarily until installation by their portion opposite to their flat top portion, in a positioning which, once the bar-shaped sliding elements have been bonded to the loop, creates a gap between each of the bar-shaped sliding elements that is at least equal to the width of one bar-shaped sliding element, so that they can fit between one another when the loop is folded in two in order to be stitched to the curtain, ironed, or packed flat, and the gap further being large enough so as to remove all contact of the loop with a pole on which the loop is placed irrespective of the pole's diameter.

15. The apparatus as claimed in claim 6, wherein the retainers comprise a repositionable adhesive allowing the at least two sliding elements to be detached from a support once they have been bonded to the loop and thus be separated from one another.

16. The apparatus of claim 6, the at least two sliding elements attached temporarily to a handling base being covered by a protective film in contact with the adhesive deposited on the face.

17. The apparatus of claim 6, each sliding element having on its face a lesser thickness at the center, at a first end, or a second end, or at both ends, depending on whether stitches of a loop exist at a central portion or at a side.

* * * * *